US006761768B2

(12) United States Patent
Coddet et al.

(10) Patent No.: US 6,761,768 B2
(45) Date of Patent: Jul. 13, 2004

(54) DEVICE FOR PRODUCING A COATING ROD FOR USE IN THE PAPER INDUSTRY

(75) Inventors: Christian Coddet, Giromagny (FR); Bernard Hansz, Nommay (FR)

(73) Assignee: BTG Eclepens S.A., Eclepens (CH)

( * ) Notice: Subject to any disclaimer, the term of this patent is extended or adjusted under 35 U.S.C. 154(b) by 358 days.

(21) Appl. No.: 10/011,460

(22) Filed: Nov. 5, 2001

(65) Prior Publication Data

US 2003/0084841 A1 May 8, 2003

Related U.S. Application Data

(63) Continuation of application No. 09/530,230, filed as application No. PCT/FR98/02300 on Oct. 27, 1998, now abandoned.

(30) Foreign Application Priority Data

Oct. 27, 1997 (FR) ..... 97 13449

(51) Int. Cl.[7] ..... B05C 5/04

(52) U.S. Cl. ..... 118/319; 118/321; 118/323; 118/500; 118/33

(58) Field of Search ..... 118/33, 58, 69, 118/319, 321, 323, 500; 427/422, 425

(56) References Cited

U.S. PATENT DOCUMENTS 4,099,481 A * 7/1978 Lyons ..... 118/702
4,397,893 A 8/1983 Bottoms

FOREIGN PATENT DOCUMENTS

JP 03076668 * 2/1991

* cited by examiner

*Primary Examiner*—Laura Edwards
(74) *Attorney, Agent, or Firm*—Clifford W. Browning; Woodard, Emhardt, Moriarty, McNett & Henry LLP

(57) ABSTRACT

The invention concerns a method which consists in maintaining the two ends (2, 4) of the bar (1) on the end supports (3, 5) of a frame (10), one of the ends (2) being maintained fixed, and in driving the bar in rotation. The invention is characterised in that it consists further in drawing the bar (1) while spraying a coat on the bar, the drawing of the bar corresponding to an elongation of about 0.2 to 0.001%.

9 Claims, 3 Drawing Sheets

DEVICE FOR PRODUCING A COATING ROD FOR USE IN THE PAPER INDUSTRY

Figure 1:
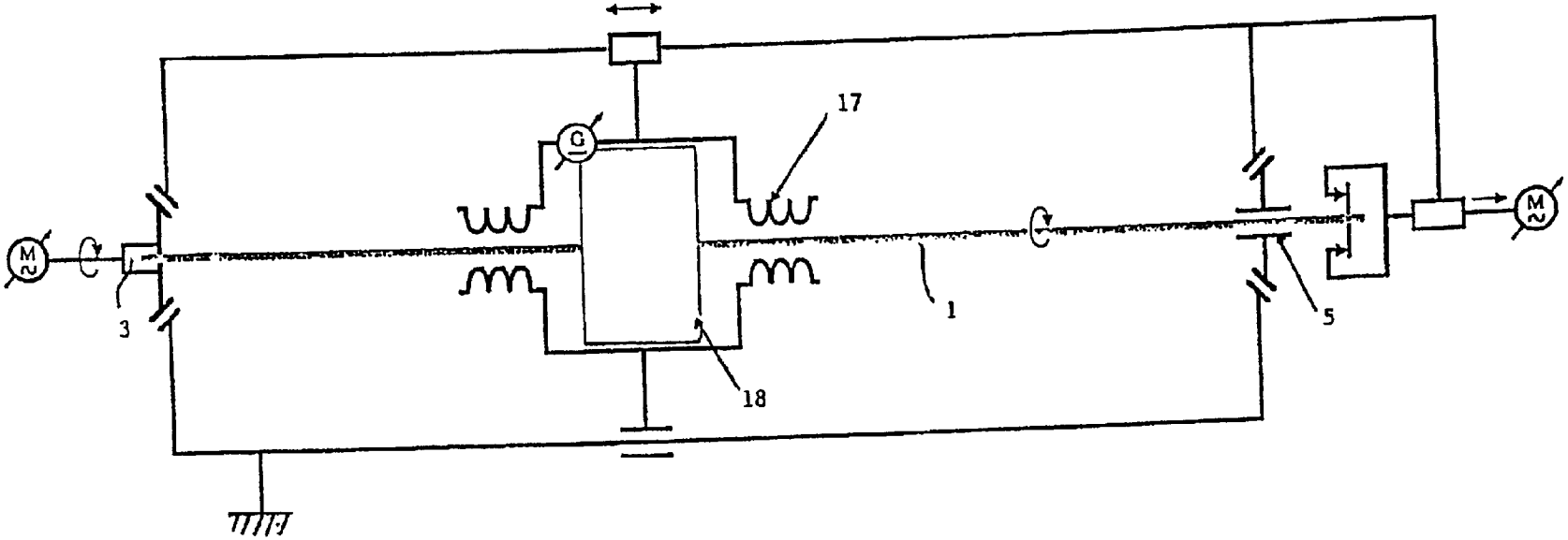

This application is a continuation of U.S. Utility patent application Ser. No. 09/530,230, filed Apr. 26, 2000, now abandoned which is a 371 of PCT/FR98/02300 filed Oct. 27, 1998.

In the paper industry, a coating material is deposited on the paper support in order to give the paper certain properties such as a smooth and hard-wearing surface.

Two main coating elements are used at present. One of the elements is constituted by composite blades forming a contact scraper for spreading the coating material moving relatively with respect to said blade. Another element is constituted by bars or rods for transferring coating material on to the paper support, said bars or rods being commonly referred to as rods in the technical sector under consideration.

The coating rods can have a smooth or fluted appearance on the surface.

When the coating rods are smooth, they serve to remove excess coating material when the latter is on the transfer roller before said coating material is transferred on to the paper support.

When the coating rods are fluted, they constitute a means of measuring out and transferring the coating material on to the paper support, owing to the fact that the coating rods go into a container of coating material so as to fill the flutes with said coating material before transferring it on to the paper support which passes over a roller.

These different techniques are well known to those skilled in the art.

As regards the use of coating rods, there are many problems to be solved.

A first problem to be solved concerns the surface condition which must be such that the transfer of coating material on to the paper must be carried out in a controlled and homogeneous manner, whatever the type of coating rod, smooth or fluted.

A second problem concerns the manufacture of the coating rod. This is because the current tendency is to use larger and larger coating rods, the length possibly reaching 10 meters and more.

A third problem concerns the production of the surfacing layer on the coating rod. When the surfacing layer is effected by thermal spraying, it is necessary to drive the coating rod rotationally during the entire deposition operation. However, one of the difficulties encountered is vibration of the coating rod which leads, for example, to bouncing of the particles which becomes greater as the vibration increases. One of the consequences of such bouncing of the particles sprayed on to the coating rod is the formation of a surfacing layer which is not uniform over the entire length of the coating rod.

A first solution advocated by the present invention is to hold the coating rod at its two ends on a frame and to center it with respect to the jaws of said frame. When the coating rod is very long, sagging at the center of the coating rod can occur. In order to reduce this sagging, it is possible to use known techniques which consist in using props positioned regularly over the length of the coating rod, the props generally being constituted by knurled wheels which are continuously being pushed by cylinders. But this is not satisfactory. This is because the knurled wheels, through their application on the coating rod, produce marks or impressions on said rod, such impressions creating surface defects at the time the surfacing layer is deposited. The more knurled wheels are used for propping up, the more there are impressions on the coating rod, the knurled wheels being separated from one another by a distance of around one meter. It is also necessary to note that a transfer of material may occur between the knurled wheels and the coating rod by friction and wear of said rod or said knurled wheels during the entire surfacing layer deposition operation.

Furthermore, and still concerning thermal deposition of the surfacing layer on the coating rod, it is necessary to take into consideration the expansion of the coating rod, created by the rise in temperature during said deposition, which expansion accentuating the sag at the center of the coating rod since the latter is held at its two ends on the frame.

The aim of the present invention is to remedy the aforementioned drawbacks and to propose a new coating rod and a new manufacturing method and a device for implementing the coating rod manufacturing method.

One object of the present invention is a method of manufacturing a coating rod, of the type consisting in holding the two ends of said rod on end supports of a frame, one of the ends being held fixed, and in driving said rod rotationally, and which is characterized in that it also consists in stretching said rod during the spraying of a surfacing layer on to said rod, the drawing out of said rod corresponding to a static elongation of around 0.2 to 0.001%.

According to another characteristic of the invention, the coating rod which is receiving a surfacing layer is held straight during the spraying of said surfacing layer.

According to another characteristic of the invention, the coating rod is made of ferromagnetic material and, more particularly, a chrome steel.

According to another characteristic, the device for implementing the method of manufacturing the coating rod is of the type comprising a frame on which there is mounted said coating rod, at least one motor rotationally driving, in a variable and adjustable manner, said coating rod, and means of thermal spraying of a surfacing layer, characterized in that it further comprises means of traction of one end of said rod, the other end being held fixed, said traction being performed during rotation of said coating rod and during the thermal spraying of said surfacing layer. The simultaneous control of the rotation and traction allows stabilization of the rod.

According to another characteristic of the present invention, the device comprises means of centering and holding at least part of the coating rod, said means being, for example, constituted by a bearing which may be magnetic, fluid or mechanical.

One advantage of the present invention lies in the fact that a perfectly stable and uniform coating rod is obtained, which allows an efficient removal of excess coating material before its transfer on to the paper support when it is smooth. In the case of fluted rods, the measuring out is performed better on account of the nature of the surfacing layer.

In all cases, the coating rod has a much longer lifetime which reduces the number of changes and therefore affords a considerable reduction in the cost of manufacturing the coated paper.

Figure 2:
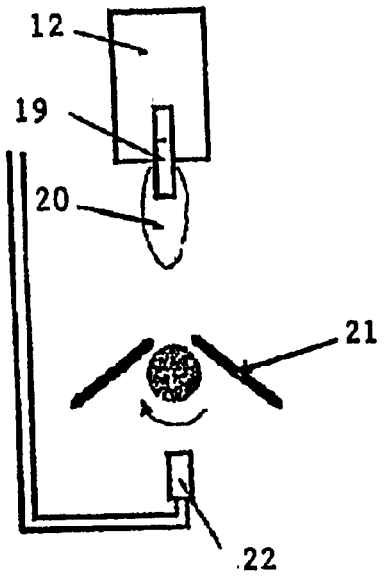
Figure 3:
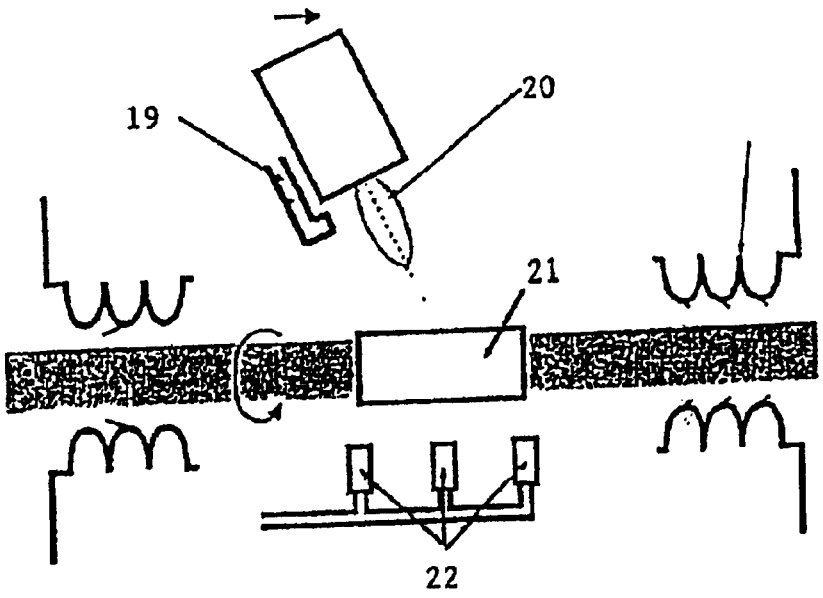
Figure 4:
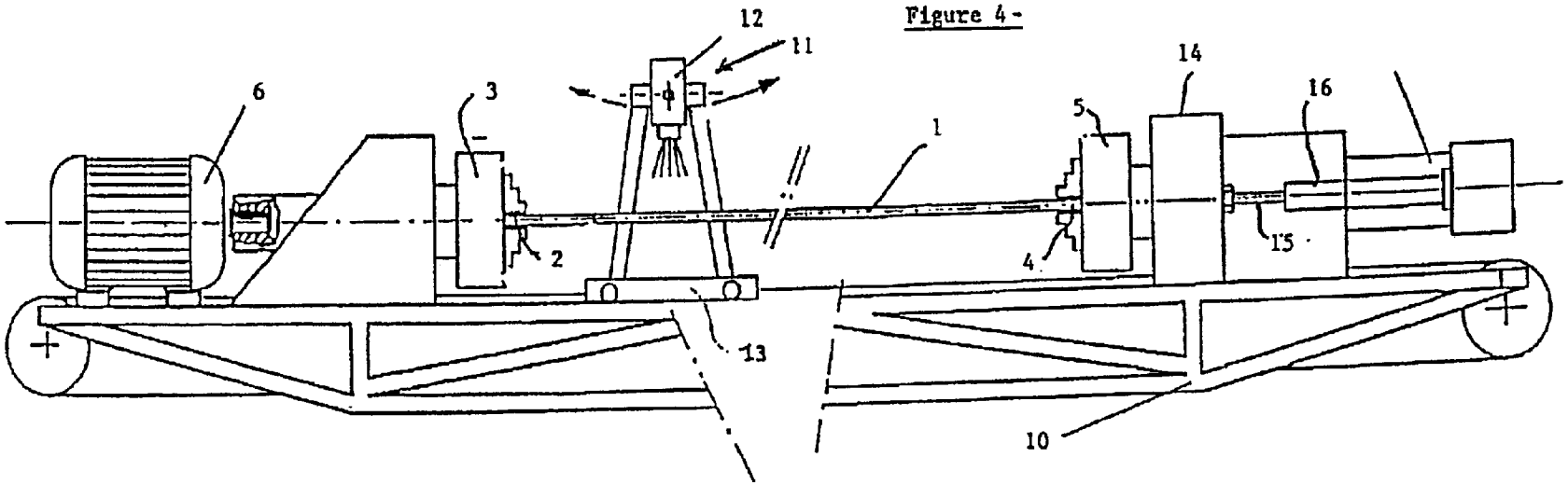

Other advantages and characteristics will emerge better from a reading of the description of the method and device according to the invention for manufacturing a coating rod, and of the accompanying drawings in which:

FIG. 1 is a schematic representation of one embodiment of the device according to the invention, FIG. 2 is a schematic representation of a side view of the device of FIG. 1, FIG. 3 is a schematic representation of a face view of the device of FIG. 1, FIG. 4 is a schematic representation of certain mechanical parts of the device of FIG. 1.

The method of manufacturing a coating rod 1 consists in mounting said rod at its two ends, one end, for example the end 2, being held fixed on a support 3, while the other end 4 is mounted on a movable support 5. The movable support 5 is moved so as to stretch said coating rod 1, with the force necessary for the desired elongation, during the thermal spraying of a surfacing layer and during the rotation of said coating rod 1. The rotation of the coating rod 1 is provided by a variable-speed motor 6. The traction performed on the end 4, by appropriate means, such as those described later, is such that the elongation of said coating rod corresponds to an elongation of between 0.2 and 0.001%.

So as to considerably reduce the vibrations of said rod 1 during rotation, the rod is held straight in the zone where the thermal spraying of the surfacing layer is performed, so as to produce a uniform surfacing layer in said zone. As, furthermore, the coating rod 1 is perfectly centered during the thermal spraying of the surfacing layer in addition to its being held straight, a coating rod is obtained which is perfectly homogeneous over its entire length, whatever this length. In fact, by virtue of the method according to the invention, it is possible to manufacture coating rods having a length greater than 10 meters for example and provided with a surfacing layer of constant thickness and with no marks. Furthermore, when the traction ceases, for example, after the surfacing layer has been placed over the entire surface of the coating rod, a compression of said surfacing layer takes place, in the direction opposite to the direction of traction. This compression of the surfacing layer increases its hardness and greatly decreases the risk of fissures appearing.

A device for implementing the method which has just been described is depicted in FIGS. 1 to 4.

The device comprises a rigid frame 10 on which there are mounted a variable-speed motor 6 for rotationally driving the coating rod 1, and two end supports 3 and 5 in which the ends 2 and 4 of said rod 1 are placed. The device comprises means of thermal spraying 11 of a powder which, after spraying on to the rod 1, constitutes the surfacing layer. The thermal spraying means 11 are constituted for example by a plasma torch 12 mounted on a carriage 13 driven translationally on the frame 10, by means of a motor, not depicted, the movement means possibly, for example, being constituted by a transmission belt. The support 3 receives the end 2 of the rod 1 and holds said end 2 fixed. The means for gripping and immobilizing the end 2 can be constituted by jaws, known per se. The other end 4 of the rod 1 is mounted in the support 5 which is immovably attached to a beam 14 mounted transversely on the frame 10 and which in its turn is immovably attached to two shafts 15 of two cylinders 16. The cylinders 16 are supplied with hydraulic and/or pneumatic energy in a manner known per se and place the rod 1 under traction, so that the latter is drawn out, towards the right in FIG. 4, and produce a traction corresponding to an elongation of the rod of around 0.2 to 0.001%.

The device also comprises means of holding and centering the rod 1, so as to hold said rod straight or horizontal or substantially horizontal during the various phases of thermal spraying of the surfacing layer, that is to say, at the various positions of the plasma torch 12 along said rod 1. When a ferromagnetic rod 1, for example, in a chrome steel is used, these holding and centering means can be constituted by a magnetic bearing 17 through which the rod 1 passes and which creates a magnetic field sufficient to avoid vibration and sagging of the rod 1. The magnetic bearing 17, whose structure is well known to specialists, is moved at the same time as the plasma torch 12 so that, in each spraying zone embodied by a rectangle 18 in FIG. 1, the rod 1 is held and centered. Other devices such as fluid bearings or mechanical bearings can be used successfully.

The plasma torch 12 comprises a powder injector 19 which is supplied with powder from a source, not depicted. The flame 20 sprays the powder on to the substrate to have a surfacing layer applied, constituted in the present case by the rod 1 driven rotationally. In order to avoid spraying powder outside the rod 1, or at the very least in undesired parts of the rod, the device according to the invention comprises an adjustable protective mask 21, in the form of a cone open at the top, so as to focus the spraying only on the part of the rod to have a surfacing layer applied. In order to avoid the expansion of the rod 1 which would be caused by the temperature of the flame 20 during deposition of the surfacing layer, one or more nozzles 22 are provided which blow $CO_2$ on to the rod, on the opposite side from the flame and, in more concrete terms, at the base of the protective mask 21.

When the coating rod 1 has a surfacing layer applied over its entire length, the cylinders 16 are released so that said rod retracts in a direction opposite the direction of traction, said retraction causing a compression of the surfacing layer which improves the cohesion of said surfacing layer and avoids the formation of fissures.

It should be noted that the combined effects of the rotational control and the tension applied to the coating rod guarantee the latter great stability during the thermal spraying operation.

The method and device according to the invention can be used for the manufacture of smooth or fluted coating rods. In the case of fluted rods, it is advantageous to produce flutes in which two consecutive flute bottoms are separated by 0.35 mm and whose radius of curvature is around 0.06 mm. The lateral sides of each flute are, preferably, inclined at 45°, the depth of the flute being preferably equal to 0.11 mm. Such flutes with a uniform and homogeneous surfacing layer of the rod allow a more accurate measuring out of the coating material on to the paper.

According to a preferred embodiment of the invention, the surfacing layer is constituted by a ceramic and the protection and limitation means (21) are constituted by adjustable lateral masks, situated either side of the coating rod (1).

I claim:

1. A device for manufacturing a coating rod (1), of the type comprising a frame (10) on which there is mounted said coating rod (1), at least one motor (6) rotationally driving said coating rod, and means (12, 19) of thermal spraying of a surfacing layer, characterized in that it further comprises means of traction (15, 16) of one end (4) of said rod, the other end (2) being held fixed, said traction being performed during rotation of said coating rod and during the thermal spraying of said surfacing layer so as to perform a drawing out corresponding to an elongation of around 0.2 to 0.001%.

2. A device according to claim 1, characterized in that it further comprises means of centering and holding (17) at least part of the coating rod.

3. A device according to claim 2, characterized in that the centering and holding means (17) are constituted by a bearing which is magnetic (17), fluid or mechanical.

4. A device according to claim 1, characterized in that it further comprises means (21) for protecting and limiting the zone of the coating rod on to which the surfacing layer is sprayed.

5. A device according to claim 4, characterized in that the protection and limitation means (21) are constituted by inclined and adjustable lateral masks, situated either side of the coating rod (1).

6. A device according to claim 1, characterized in that it also comprises cooling means (22), said cooling means being placed on the opposite side from the side of the rod subjected to the thermal spraying.

7. A device according to claim 6, characterized in that the cooling means (22) are constituted by nozzles blowing $CO_2$.

8. A device according to claim 1, characterized in that the traction means are constituted by cylinders (16) mounted on the frame.

9. A device according to claim 1, characterized in that it further comprises a carriage (13) which can move parallel to the longitudinal direction of the traction rod, the spraying means (12), constituted in a known manner by a plasma torch for spraying powders, being mounted on said carriage.

* * * * *